US006443507B1

(12) United States Patent
Korvemaker

(10) Patent No.: US 6,443,507 B1
(45) **Date of Patent: *Sep. 3, 2002**

(54) CLAMPING STRAPS WITH SAFETY MECHANISM FOR CONTAINER COVERS

(75) Inventor: Albert Korvemaker, Deventer (NL)

(73) Assignee: Akzo Nobel NV, Arnhem (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/716,431

(22) PCT Filed: Mar. 23, 1995

(86) PCT No.: PCT/EP95/01109

§ 371 (c)(1),
(2), (4) Date: Sep. 24, 1996

(87) PCT Pub. No.: WO95/26911

PCT Pub. Date: Oct. 12, 1995

(30) Foreign Application Priority Data

Apr. 1, 1994 (NL) ..... 9400523

(51) Int. Cl.[7] ..... B65D 45/32
(52) U.S. Cl. ..... 292/256.6; 292/256.67
(58) Field of Search ..... 292/256.6, 256.65, 292/256.67, 256.69, 299; 220/203.12, 321

(56) References Cited

U.S. PATENT DOCUMENTS

| | | | | | |
|---|---|---|---|---|---|
| 2,351,484 | A | * | 6/1944 | Carpenter | 220/321 |
| 2,486,565 | A | * | 11/1949 | Kojan et al. | 292/256.67 X |
| 2,813,285 | A | * | 11/1957 | Aslin et al. | 292/256.65 |
| 3,762,595 | A | | 10/1973 | Green | 220/44 R |
| 3,964,774 | A | * | 6/1976 | Wollin et al. | 292/256.69 X |
| 4,100,860 | A | * | 7/1978 | Gablin et al. | 109/83 |
| 4,218,964 | A | * | 8/1980 | Beadle | 99/275 |
| 4,721,224 | A | * | 1/1988 | Kawabata | 220/469 |
| 5,193,864 | A | * | 3/1993 | Coleman | 292/256.67 |
| 5,215,206 | A | | 6/1993 | Siblik | 220/320 |
| 5,240,027 | A | * | 8/1993 | Vertanen | 220/203 |

FOREIGN PATENT DOCUMENTS

| | | | | |
|---|---|---|---|---|
| CH | 202839 | | 11/1938 | |
| DE | 351760 | * | 4/1920 | 292/256.67 |
| DE | 817118 | * | 10/1951 | 292/256.69 |
| DE | R13714 | * | 3/1954 | 292/256.69 |
| DE | 959427 | * | 3/1957 | 220/321 |
| DE | 6942649 | | 10/1969 | |
| DE | 33 39 109 | | 5/1985 | |
| DK | 76552 | * | 10/1953 | 292/256.65 |
| EP | 0 308 554 | | 3/1989 | |
| FR | 671146 | * | 8/1929 | 292/256.65 |
| WO | WO 94/01337 | | 1/1994 | |

* cited by examiner

*Primary Examiner*—Gary Estremsky
(74) *Attorney, Agent, or Firm*—Richard P. Fennelly; Lainie E. Parker; Ralph J. Mancini

(57) ABSTRACT

A method and container for transporting and storing chemical compounds susceptible to exothermic decomposition. The method including placing the chemical compounds in a container where the opening and the rim of the container are sealed by means of a cover and a clamping strap, and the clamping strap is designed to release the cover from the rim of said container at a predetermined level of superatmospheric pressure in the container to open up the entire top for relief of the superatmospheric pressure. When exothermic decomposition occurs, the invention provides substantial and instant pressure relief, which, in turn, avoids cracking and/or fragmentation of the container.

16 Claims, 2 Drawing Sheets

CLAMPING STRAPS WITH SAFETY MECHANISM FOR CONTAINER COVERS

The invention pertains to the use of a clamping strap for sealing, by means of a cover, containers for the transportation and storage of chemical compounds liable to exothermic decomposition, which clamping strap will release the cover at a certain level of superatmospheric pressure in the container.

Compounds liable to exothermic decomposition will decompose above a certain critical temperature to produce gas and heat. The heat produced further promotes the decomposition. For that reason, these types of compounds, as well as solutions, dilutions, suspensions, and emulsions containing these types of compounds, are referred to as "unstable substances" or "exothermically decomposing substances." Examples of such compounds are organic peroxides, such as tert.-butyl peroxybenzoate, tert.-butyl peroxypivalate (up to 77% in solution), tert.-butyl peroxy-2-ethylhexanoate, and tert.-butyl peroxyisopropyl carbonate (up to 77% in solution); other organic peroxides, such as 2,5-dimethyl-2,5-ditert.-butyl peroxyhexane, tert.-butyl peroxyacetate (up to 52% in solution), di(3,5,5-trimethyl hexanoyl) peroxide (not more than 77% in solution), and methylethylketone peroxides (not more than 40% dissolved in diisobutyl nylonate); inorganic peroxides, such as hydrogen peroxide, ammonium peroxydisulphate, alkaliperborates, alkalipercarbonates, ammonium peroxymonosulphate, alkaline earth peroxyborates, and alkaline earth persulphates; azo compounds, such as 2,2'-azo di-(2,4-dimethyl)valeronitrile 50% in methylethylketone; nitrate compounds, such as 2-ethylhexylnitrate; nitrile compounds, such as pentylnitrite; sulphohydrazides, such as benzene sulphohydrazide, N-nitroso compounds, nitro compounds, and organic nitrates.

Shipping and storing chemical compounds liable to exothermic decomposition is extremely difficult in that the build-up of decomposition gases during exothermic decomposition is exponential, which may lead to the container fragmentating or cracking.

The IMO/ADR has turned the United Nations' "Recommendations on the Transport of Dangerous Goods" with regard to the design of such containers into a series of requirements. For, say, peroxides, one of these requirements stipulates leak-tight transportation and/or storage in containers which have to be proof against cracking or fragmentating in the case of the peroxides exothermic decomposition. European Patent Application EP 0 308 544 discloses a container for the transportation and storage of the above-mentioned compounds. The document describes a container equipped with a conduit of which the inlet is at or near the bottom of the container. In one particular embodiment the conduit is also provided with a so-called rupture disk, which is set to burst at a predetermined pressure, relieving the pressure in the vessel. Such a design is formed integral with the container and cannot, in actual practice, be fitted to existing containers.

It was found that clamping straps which will release the cover at a certain level of superatmospheric pressure in the container, opening up the entire top for relief of the superatmospheric pressure, are pre-eminently suited to be used on containers for the transportation and storage of chemical compounds liable to exothermic decomposition. Accordingly, the invention consists in the use of a clamping strap on such containers. The level of superatmospheric pressure at which the clamping strap will release the cover is determined on the basis of the maximum pressure the container is capable of withstanding before cracking or fragmentating. The level of superatmospheric pressure at which the cover is released is dependent on the clamping strap, and thus different clamping straps can be employed for different levels of superatmospheric pressure. Alternatively, if the clamping strap is adjustable, the same clamping strap can be used for different levels of superatmospheric pressure.

One advantage of the invention consists in that it permits the leak-tight transportation and/or storage of peroxides and, in conformity with IMO/ADR requirements, prevents the container from cracking or fragmentating under the (exponential) build-up of pressure. A further advantage consists in that the clamping strap can be made or modified separately and fitted to existing containers.

Such clamping straps are known in themselves. Swiss Patent Specification CH 202839 discloses a clamping strap with a partially semi-circular section in cross-section, which encloses virtually the entire circumference of both a cover and the rim of a container. The strap is cut, and across the cut a spring is provided which pulls the ends of the strap toward each other. The intention of the design is to fit covers for milk containers in such a way as to facilitate their easy removal and re-attachment.

A closure device with a spring is also known from German Patent Application DE 33 39 109. Here, the spring connects the closure device with a clamping wire, ensuring that the clamping wire will fit around containers of slightly varying opening diameter. The design is intended to be used with plastics vessels and covers which age and are subject to a certain amount of shrinkage in the process.

A closure device with a spring is further described in German Utility Model DE-GM 6942649. The use of the design described in this document corresponds to that of the aforementioned German Patent Application, except that the spring is located on the grip, making for a less narrow structure.

The clamping strap may be used on containers of different specifications, e.g., in terms of contents. It is possible to equip the container with insulating material or with a pressure relief valve 11. This valve's function is to blow off gases; however, it will not prevent the container from cracking or fragmentating if there is exothermic decomposition of peroxides.

Preferably, use is made of a clamping strap comprising a ring-shaped, cut strap which has a wholly or partially semi-circular section or U-shaped section of which the legs diverge somewhat and encloses both the cover and the rim of the container opening, the strap being provided with a safety device having one or more springs which, at a certain level of pressure in the container, causes such a widening of the circumference of the strap that the cover is released. The stiffness of the spring can be selected such as to give a safety device which is sufficiently tight to guarantee leak-tight sealing of the cover onto the container, yet slack enough to release the cover at a particular level of pressure. For reasons of easy and inexpensive maintenance, replacement of parts, and manufacture, the safety device preferably is composed of an eye-shaped member fitted on either side of a cut in the strap, such that a bar can be passed through the two eye-shaped members. Across the bar a spring can be mounted on one or both sides of the cut.

As examples of eye-shaped members may be mentioned rings or bushings. As examples of bars may be mentioned bolts, studs or stud bolts. If two springs are employed, the safety mechanism will be less stiff and hence suitable for use with containers permitting only a very slight degree of superatmospheric pressure. Alternatively, it is possible to fit members about the bar at the end of the spring or springs, which members may be welded in place. It is also possible to distort the bar, as shown in FIG. 3 in order to keep the spring or springs in place. The preferred method, however, is to use a stud bolt, with the spring(s) being kept in place by means of a nut or nuts and, optionally, a lock. The resulting safety mechanism can be used to cover a wide superatmospheric pressure interval, since the compression of the spring(s), and thus their tension, can be set by tightening the nuts to a greater or lesser extent. If this does not suffice, it is easy to install a spring or springs of a different stiffness.

For easier fitting and removal the clamping strap can additionally be provided with a closure device known in itself.

Containers for the transportation and storage of chemical compounds liable to exothermic decomposition sealed with a cover through the use of the above-mentioned clamping straps are covered by the invention. The present invention also comprises novel clamping straps which are especially suited to the above-mentioned application.

The novel clamping strap comprises a ring-shaped, cut strap with a closure device and a cross-section which is a wholly or partially semi-circular section or U-shaped section of which the legs diverge somewhat, with on either side of the cut an eye-shaped member through which a bar is passed, about which bar a spring is fitted on one or both sides of the cut.

Examples of fitting such eye-shaped members to the clamping strap and passing bars through them can be found in PCT Application WO 94/01337 and in U.S. Pat. No. 5,215,206. However, the clamping straps described in said documents are not suited to be used on containers for the transportation and storage of chemical compounds liable to exothermic decomposition. U.S. Pat. No. 3,762,595 discloses a ring-shaped, cut cover band with an eye-shaped aperture on either side of the cut. The cover band encloses the container cover and edge. Between the cover and the container a gasket member is provided which at a certain elevated pressure within the sealed container will be displaced, at least into the area of the bolt location of the cover band, thereby creating an aperture for venting the elevated pressure. This design is not suited to be used on containers for the transportation and storage of chemical compounds liable to exothermic decomposition either, since the cleared aperture is far too narrow for venting a n exponentially increasing pressure.

If the spring or springs are kept in place by means of a nut, their compression, and hence their tension, becomes adjustable.

The invention will be further elucidated below with reference to the embodiment depicted in the drawings.

Figure 1:
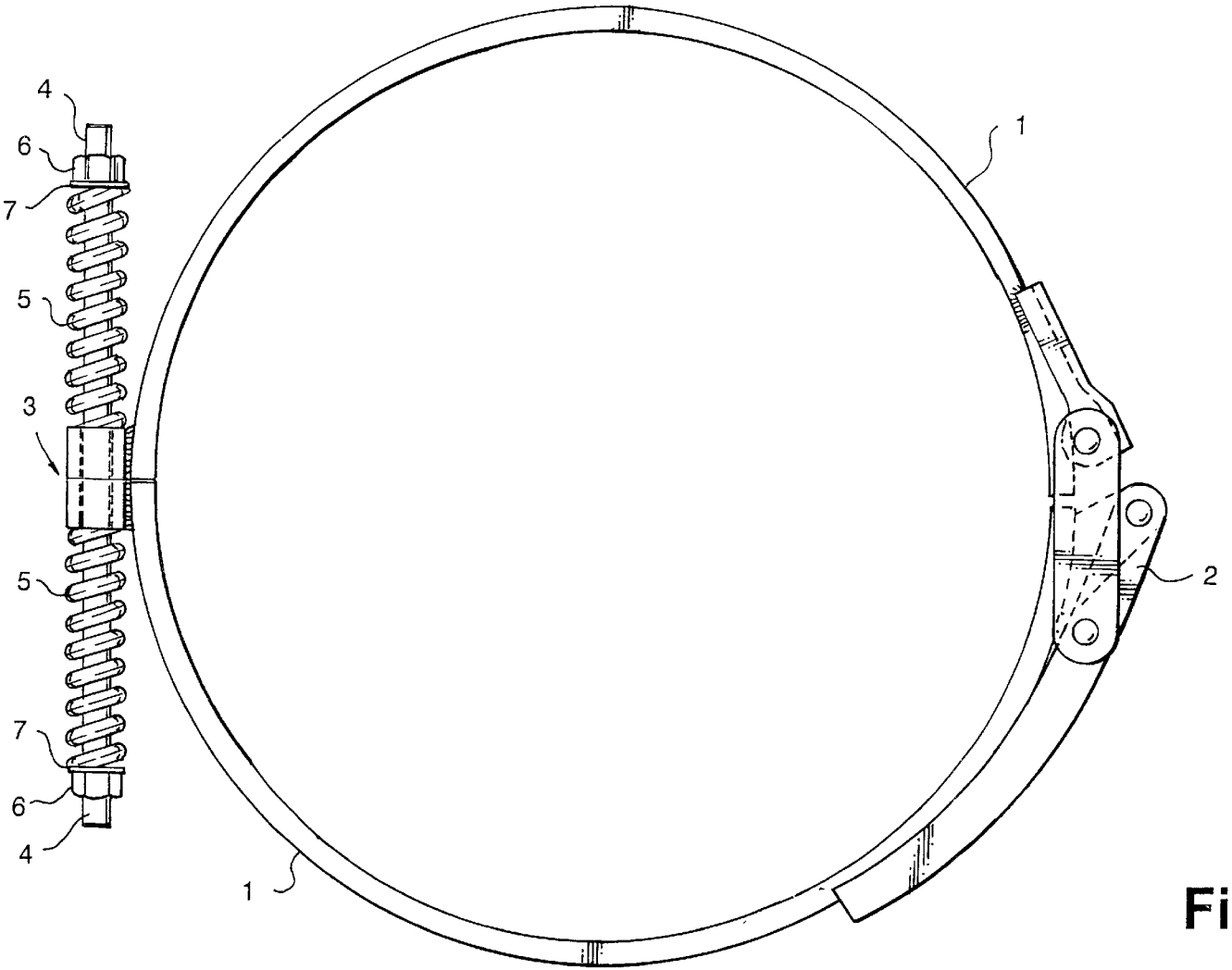
FIG. 1 is a schematic top view of an embodiment of a clamping strap equipped with a safety mechanism.

An existing clamping strap 1 is cut immediately opposite to the conventional closure device 2, while on either side of the cut a bushing 3 is fitted. The two bushings 3 are connected to the clamping strap 1 at the cut in tangential direction (of the clamping strap 1) and in the same straight line. Through the bushings 3 is passed a stud bolt 4. Around this stud bolt 4 is slid on either end a spring 5, which is kept in place by a nut 6 and a retainer ring 7 and with the aid of this nut 6 can also be set to a particular tension. See FIG. 1.

Figure 2:
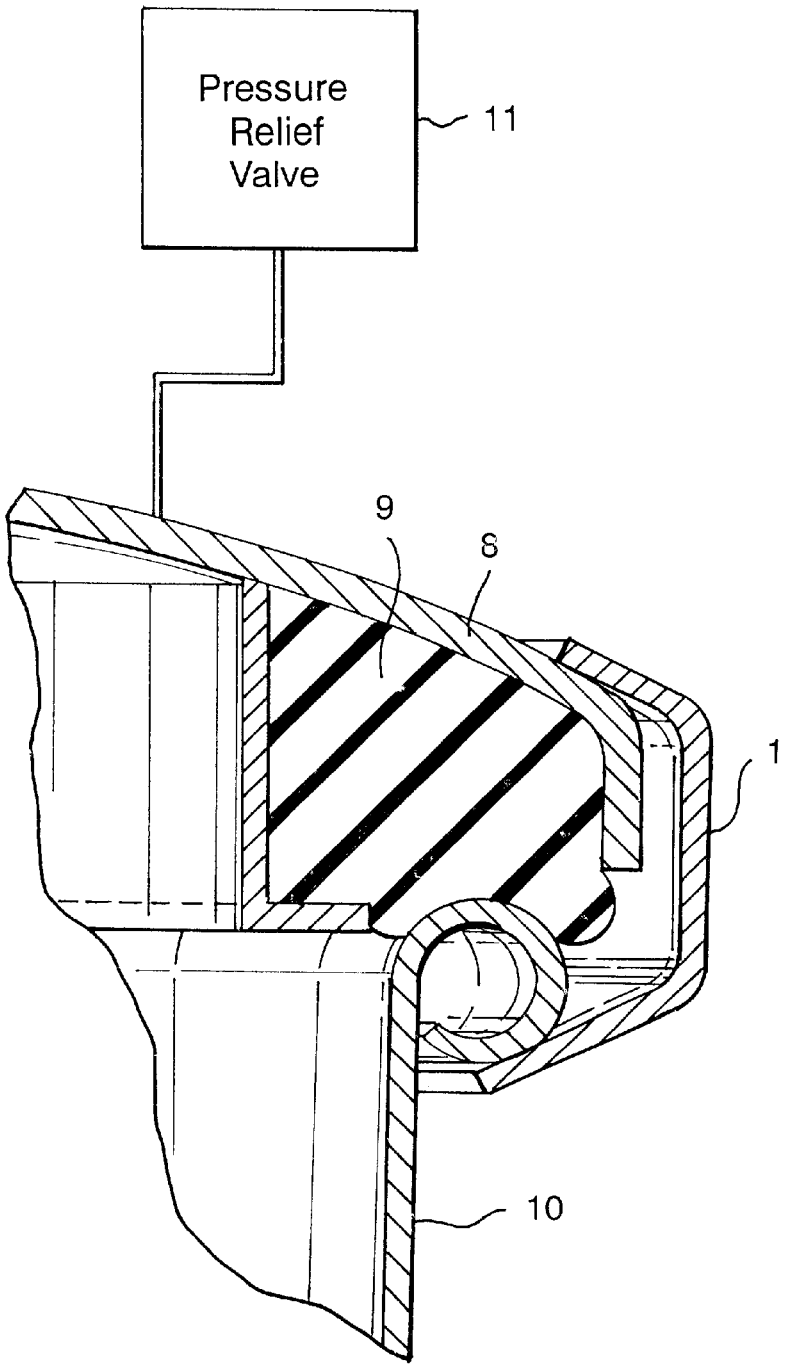
FIG. 2 is a schematic cross-section of a clamping strap pressing a cover down on a container.

The clamping strap 1 is used to attach a cover 8 with a packing 9 to a container 10. See FIG. 2.

For the experiments described below, a clamping strap such as schematically depicted in the above-mentioned figures is fitted to a 1000 l -content Intermediate Bulk Container (IBC) for the transportation and storage of peroxides. The container has a circular opening of 40 cm in diameter and a wall thickness of at least 1,5 mm. The springs have 9 windings with a wire diameter of 7 mm and a spring constant of 1000 kg/cm. As a result of this selection of springs and the position of the nuts the maximum pressure is set at 1,2 bar superatmospheric pressure.

EXAMPLE 1

The container of the above-described embodiment was filled with about 250 l of Trigonox 36 CD37.5 (bis(3,3,5-trimethyl hexanoyl)peroxide) and mounted in a frame. The side walls of the container were insulated, in this case for experimental reasons. Three electric heating coils with a wire length of 4 meters and a capacity of 3 kW were placed in the container below the liquid level in order to ensure as uniform heating of the contents as possible, as well as stimulation and acceleration of the peroxide's self-heating. During the test the temperature and the pressure were measured. At a current of 7 A (220V) the temperature increased by 0,7–1,0° C./min, with heating continuing until the end of the experiment. At a temperature of about 175° C. and a superatmospheric pressure of 1,15 bar the cover was released and the pressure relieved. The safety device functioned satisfactorily and the container suffered only slight deformation.

EXAMPLE 2

Analogous to Example 1, except that the container was placed on an open fire instead of being electrically heated internally. After well over 75 minutes the cover was released. The maximum pressure, measured just prior to the release of the cover, was 1,2 bar. The safety device functioned satisfactorily and the container did not crack.

What is claimed is:

1. A container for the transportation and storage of chemical compounds susceptible to exothermic decomposition, the container having a pressure relief valve [capable of] for blowing off gases, but insufficient for preventing the container from cracking or fragmenting upon the exothermic decomposition of the chemical compounds, the container having an opening, a cover for the opening and a clamping strap, the opening of the container being sealed with the cover by the clamping strap, the clamping strap being designed to release the cover to open up the entire opening in response to a predetermined level of superatmospheric pressure in the container for preventing the container from cracking or fragmenting under the exponential build-up of pressure upon the exothermic decomposition of the chemical compounds, the predetermined level of superatmospheric pressure being at most, the maximum pressure the container is capable of withstanding before cracking or fragmenting.

2. The container of claim 1, wherein the clamping strap is ring-shaped and has at least first and second confronting ends, first and second eye-shaped members, the first eye-shaped member is mounted on the first confronting end, the second eye-shaped member is mounted on the second confronting end, a bar which is passed through the first and second eye-shaped members, first and second retaining means, the first retaining means is on the bar opposite the first eye-shaped member, the second retaining means is on the bar opposite the second eye-shaped member, first and second springs, the first spring is fitted around the bar between the first eye-shaped member and the first retaining means, the second spring is fitted around the bar between the second eye-shaped member and the second retaining means, wherein the first and second retaining means operate to retain the spring on the bar when the clamping strap seals the cover to the rim of the opening.

3. The container of claim 2, wherein at least one of the first and second springs has sufficient stiffness to enable the clamping strap to release the cover at the predetermined level of superatmospheric pressure.

4. The container of claim 2, wherein at least one of the first and second springs is sufficiently compressed by moving the retaining means towards the eye-shaped member to enable the clamping strap to release the cover at the predetermined level of superatmospheric pressure.

5. The container of claim 2, wherein the first and second eye-shaped members are rings or bushings, the bar is a bolt, stud or stud bolt, and the retaining means is a nut or a [bend] distortion in the bar.

6. The container of claim 5, wherein the first and second eye-shaped members are bushings, the bar is a stud bolt, and the retaining means is a nut.

7. A method for transporting and storing chemical compounds susceptible to exothermic decomposition which comprises placing said chemical compounds in a container, and sealing an opening in said container by means of a cover and a clamping strap, the clamping strap being provided to clamp the cover to the rim of the opening and to release the cover from the rim of the opening of the container to open up the entire opening in response to a predetermined level of superatmospheric pressure in the container to prevent the container from cracking or fragmenting under the exponential build-up of pressure upon the exothermic decomposition of the chemical compounds, the predetermined level of superatmospheric pressure being at most, the maximum pressure the container is capable of withstanding before cracking or fragmenting and [wherein the] further comprising providing the container with a pressure relief valve which operates to blow off gases, but is insufficient to prevent the container from cracking or fragmenting upon the exothermic decomposition of the chemical compounds.

8. The method of claim 7, wherein the clamping strap is ring-shaped and has at least first and second confronting ends, first and second eye-shaped members, the first eye-shaped member being mounted on the first confronting end, the second eye-shaped member being mounted on the second confronting end, a bar which is passed through the first and second eye-shaped members, first and second retaining means, the first retaining means being on the bar opposite the first eye-shaped member, the second retaining means being on the bar opposite the second eye-shaped member, first and second springs, the first spring being fitted around the bar between the first eye-shaped member and the first retaining means, the second spring being fitted around the bar between the second eye-shaped member and the second retaining means, wherein the first and second retaining means operate to retain the spring on the bar when the clamping strap seals the cover to the rim of the opening.

9. The method of claim 8, wherein the first and second eye-shaped members in the clamping strap are rings or bushings, the bar is a bolt, stud or stud bolt, and the retaining means is a nut or a distortion in the bar.

10. The method of claim 8, further comprising adjusting at least one of the first and second springs by selecting the spring to have a sufficient stiffness to enable the clamping strap to release the cover at the predetermined level of superatmospheric pressure.

11. The method of claim 8, further comprising adjusting at least one of the first and second springs by moving the retaining means towards the eye-shaped member to sufficiently compress the spring to enable the clamping strap to release the cover at the predetermined level of superatmospheric pressure.

12. A method for transporting and storing chemical compounds susceptible to exothermic decomposition, comprising:

placing the chemical compounds in a container;

sealing a cover to the rim of an opening of the container via a clamping strap which releases the cover to open up the opening to relieve the superatmospheric pressure caused by the exothermic decomposition of the chemical compounds;

the clamping strap being ring-shaped and having at least first and second confronting ends, first and second eye-shaped members, the first eye-shaped member being mounted on the first confronting end, the second eye-shaped member being mounted on the second confronting end, a bar which is passed through the first and second eye-shaped members, first and second retaining means, the first retaining means being on the bar opposite the first eye-shaped member, the second retaining means being on the bar opposite the second eye-shaped member, first and second springs, the first spring being fitted around the bar between the first eye-shaped member and the first retaining means, the second spring being fitted around the bar between the second eye-shaped member and the second retaining means, wherein the first and second retaining means operate to retain the spring on the bar when the clamping strap is sealing the cover to the rim of the opening; and adjusting at least one of the first and second springs so that the clamping strap releases the cover in response to a predetermined level of superatmospheric pressure, the predetermined level of pressure being at most, the maximum pressure the container can withstand before cracking or fragmenting.

13. The method of claim 12, further comprising providing the container with a pressure relief valve which operates to blow off gases, but is insufficient for preventing the container from cracking or fragmenting upon the exothermic decomposition of the chemical compounds.

14. The method of claim 13, wherein at least one of the first and second springs is adjusted by selecting a spring having a sufficient stiffness to enable the clamping strap to release the cover at the predetermined level of superatmospheric pressure.

15. The method of claim 13, wherein at least one of the first and second springs is adjusted by moving the retaining means towards the eye-shaped member to sufficiently compress the spring to enable the clamping strap to release the cover at the predetermined level of superatmospheric pressure.

16. The method of claim 13, wherein the first and second eye-shaped members in the clamping strap are rings or bushings, the bar is a bolt, stud or stud bolt, and the retaining means is a nut or a distortion in the bar.

* * * * *

UNITED STATES PATENT AND TRADEMARK OFFICE

CERTIFICATE OF CORRECTION

PATENT NO. : 6,443,507 B1
DATED : September 3, 2002
INVENTOR(S) : Korvemaker

It is certified that error appears in the above-identified patent and that said Letters Patent is hereby corrected as shown below:

Column 4,
Line 42, remove "[capable of]" after "relief value"

Column 5,
Line 18, remove "[bend]" after "a"
Line 37, remove "[wherein the]" after "and"

Signed and Sealed this

Eleventh Day of February, 2003

JAMES E. ROGAN
*Director of the United States Patent and Trademark Office*